United States Patent [19]

Vendur

[11] 3,962,742

[45] June 15, 1976

[54] HAIR STYLING BRUSH

[76] Inventor: John Vendur, 1228 Scalp Ave., Johnstown, Pa. 15904

[22] Filed: June 13, 1975

[21] Appl. No.: 586,581

[52] U.S. Cl. ..... 15/201; 15/184; 132/85

[51] Int. Cl.[2] ..... A46B 7/02

[58] Field of Search ..... 15/159, 160, 168, 169, 15/184, 201; 132/117–123, 143, 147, 85, 9, 33, 39

[56] References Cited

UNITED STATES PATENTS

| | | | |
|---|---|---|---|
| 1,513,630 | 10/1924 | Salac | 132/121 |
| 2,244,068 | 6/1941 | Kay | 132/123 |
| 3,148,685 | 9/1964 | Haynes et al. | 132/123 |
| 3,260,269 | 7/1966 | Zurndorfer | 132/123 |
| 3,381,693 | 5/1968 | Stevens | 132/123 X |

*Primary Examiner*—Peter Feldman
*Attorney, Agent, or Firm*—Buell, Blenko, and Ziesenheim

[57] ABSTRACT

A hair styling brush having means for retracting the brush bristles within the brush housing after the hair has been shaped thereon. By retracting the bristles, a hair stylist can remove the brush without affecting the integrity of the hair formation.

8 Claims, 5 Drawing Figures

Fig. 1.
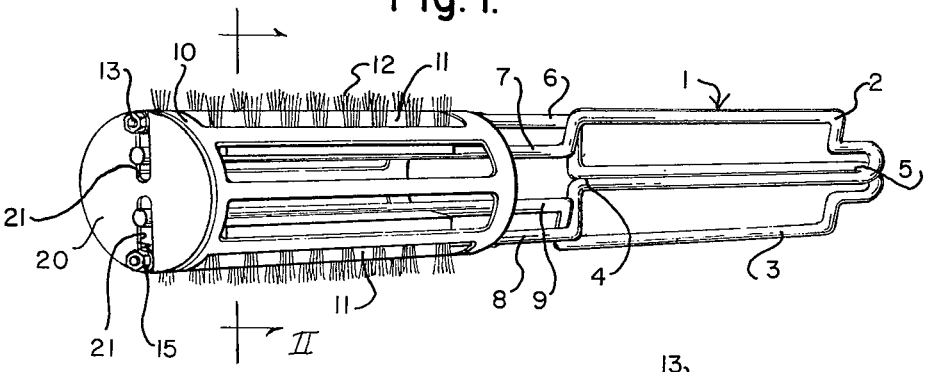
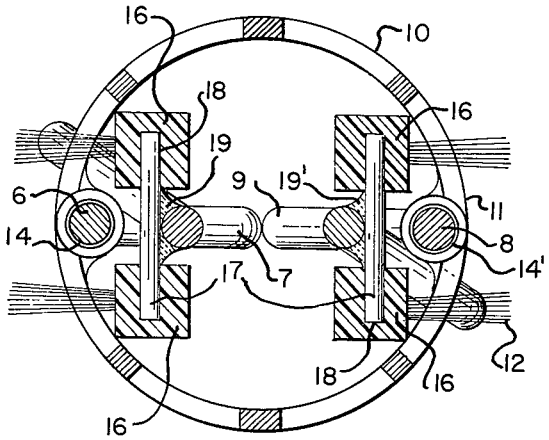
Fig. 2.
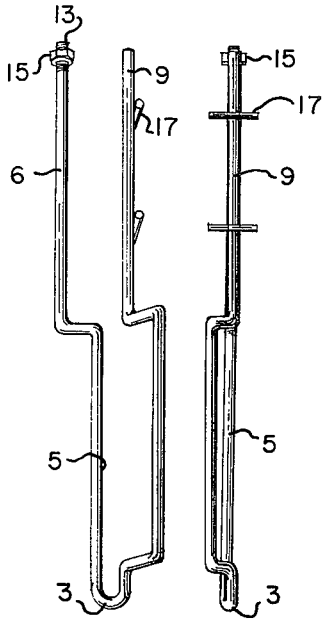
Fig. 3. Fig. 4.
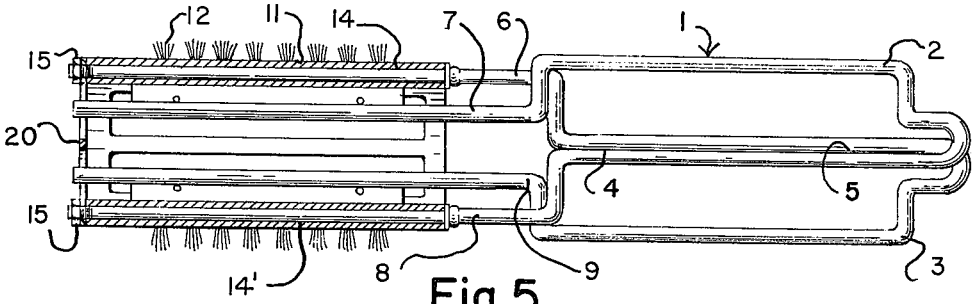
Fig. 5.

HAIR STYLING BRUSH

This invention relates to a hair styling brush and particularly to a hair styling brush which can be removed from the hair which has been formed thereon without disturbing the integrity of the hair formation. At the present time, it is the practice of barbers and hair stylists to form and shape the longer hair styles in fashion today by using a brush and a heat generating apparatus. The hair is formed on the brush while heat is being applied to the hair. Removal of the brush from the hair formation presents a problem in that the brush is usually removed by reversing the motion that caused the hair to be formed in the particular shape desired. Removal of the brush, therefore, has seriously affected the integrity of the formation. Certain apparatus has been proposed which could be removed without disturbing the integrity of the hair formation. However, none of the previous apparatus could be used in conjunction with a hand held hair drying apparatus, nor did they provide finished style after removal.

The present invention provides a novel and significant improvement over the present brushes for styling hair. The invention permits a stylist to form and shape the hair with a brush without the necessity of disturbing the final shape when removing the brush. The brush of the present invention saves considerable time and labor for the hair stylist. The open brush housing allows a free flow of air from the hand held dryer used in conjunction with the brush by the hair stylist, thereby reducing the drying time for forming and shaping the hair. Also, the stylist in using the brush need only roll a section of hair in one direction to form and shape it and can retract the brush without the necessity of rolling the hair in the opposite direction. This roll in one direction only helps maintain the integrity of the style. In the preferred embodiment of the invention, I provide a handle formed from two members. Each member has two prongs. Two of the prongs are fixably attached to the brush housing and two prongs are attached to bristle housing means which are inserted into the brush housing with the bristles extending outwardly thereof. The two prongs which are attached to the bristle housing means are compressible inwardly and compression results in the withdrawing of the bristles inward of the brush housing. In operation hair would be formed and shaped by means of the bristles extending outward of the brush housing. After the hair stylist has shaped the hair, the stylist would compress the prongs of the handle members attached to the bristle housing means and withdraw the bristles to within the brush housing. The brush could then be removed without affecting the integrity of the hair formation.

In the foregoing general description, I have set out certain purposes, objects and advantages of my invention. It will be described hereafter and will become apparent for those skilled in the art of hair styling and shaping when considering the following description and drawings in which:

FIG. 1 is a perspective view of the hair styling brush of the present invention;

FIG. 2 is a transverse section taken along line II—II of FIG. 1;

FIG. 3 is a side view of one handle member;

FIG. 4 is an end view of the handle of FIG. 3 as seen from the right thereof; and FIG. 5 is a longitudinal sectional view partly in elevation generally taken along line V—V of FIG. 2.

Referring to the drawing I have shown in FIG. 1, a hair styling brush having a handle 1 which is comprised of two members 2 and 3. Members 2 and 3 are made of steel spring wire and are joined by a weld or other means well known in the art along edges 4 and 5. The brush handle members could be made of a plastic or any other suitable material. Each member 2 and 3 has two prongs 6, 7, 8 and 9. Brush housing 10 has openings 11 which permit bristles 12 to extend outwardly thereof. Brush housing means 10 is fixably attached to prongs 6 and 8. Prongs 6 and 8 have threads on one end thereof and the housing means has channels 14 and 14′ extending the length thereof which receive prongs 6 and 8. Threads 13 of prongs 6 and 8 extend outward of channels 14 and 14′. Stamped guide means 20 having slots 21 is fitted over threads 13 of prongs 6 and 8. Prongs 6, 7, 8 and 9 extend through slots 21. Guide 20 and prongs 6 and 8 are secured to the brush housing 10 by means of nuts 15 fastened to threads 13.

Bristle housing means 16 mounted on prongs 7 and 9 have bristles 12 extending therefrom. Bristles 12 are inserted in housing means 16 by means well known in the art. Arms 17 extends into slots 18 of the bristle housing means and thereby keep housing means 16 in operable engagement with prongs 7 and 9 by means of welds to the prongs at joints 19 and 19′. It can be seen that a hair stylist by exerting compressive force on prongs 7 and 9 of handle members 2 and 3 can withdraw bristles 12 to within housing 10. Release of the compressive force will cause the bristles to return to their original position.

In operation a hair stylist would take the brush and form the hair by means of bristles 12 around housing 10. Once the hair has been formed to the proper shape the brush can be withdrawn by the stylist exerting compressive force on prongs 7 and 9 which will cause the bristles to withdraw from contact with the hair to within housing 10. Once the force is released the bristles will return to their original position. The design of brush of the invention allows the stylist to withdraw the brush from the completed shaped hair without destroying its integrity with one hand while the other remains free to manipulate a hair drying apparatus.

In the foregoing specification I have set out a certain preferred embodiment of my invention, however, it will be understood that this invention may be otherwise embodied within the scope of the following claims.

I claim:

1. A hair styling brush comprising:
   a. a handle comprised of two members each of said members having first and second prongs,
   b. brush housing means fixably attached to said first prong means of each of said handle members,
   c. bristle housing means fixably attached to the second prong means of each of said handle member, said bristle housing means extending inwardly of said brush housing member; and
   d. bristles extending from said bristle housing means extending outwardly of said brush housing means through apertures in said brush housing means.

2. The hair styling brush of claim 1 wherein the handle members are made of steel spring wire and are welded together to form said handle.

3. The hair styling brush of claim 1 wherein two bristle housing means are fixably attached to the first prong means of the handle member.

4. A hair styling brush comprising:

a. a handle comprised of two members formed from steel wire each of said members having first and second prong means, b. said first prong means of each of said handle member having threads thereon and being adapted to receive a brush housing member, c. an apertured brush housing member adapted to receive said threaded prongs, d. bolt means for attaching said apertured brush housing member to said threaded prongs, e. said second prong of each handle member being adapted to receive bristle housing means, f. said bristle housing means fixably attached to said second prong means; and g. bristles extending from said bristle housing means outwardly of said brush housing means through the apertures therein.

5. The hair styling brush of claim 4 wherein guide means are attached to said brush housing and engage said second prong means.

6. A hair styling brush comprising:

a. a handle having two members formed from steel spring wire each of said members having first and second two prong means, b. said first prong means of each said handle member being adapted to receive a brush housing member, c. an apertured brush housing member adapted to receive said first prong means, d. guide means adapted to fit over one end of said apertured brush housing member and adapted to engage both said first threaded prong means of second prong means of each said handle member, e. fastener means for attaching said apertured brush housing member and said guide means to said threaded prong means, f. said second prong means of each handle member being adapted to receive bristle housing means; and g. bristle housing means fixably attached to second prong means of each handle member inwardly of said brush housing means; and bristles also extending from said bristel housing means outwardly of said brush housing means through apertures therein.

7. The hair styling brush of claim 6 wherein said handle means are welded together at the face of said first prong means form the handle.

8. The hair styling brush of claim 6 wherein two bristle housing means are fixably attached to each second prong means of each handle member.

* * * * *